US008074321B2

(12) United States Patent
Fry et al.

(10) Patent No.: US 8,074,321 B2
(45) Date of Patent: Dec. 13, 2011

(54) DUAL-TANK VACUUM CLEANER

(75) Inventors: Kevin D. Fry, South Williamsport, PA (US); Robert Lent Crevling, Jr., Williamsport, PA (US)

(73) Assignee: Shop Vac Corporation, Williamsport, PA (US)

( * ) Notice: Subject to any disclaimer, the term of this patent is extended or adjusted under 35 U.S.C. 154(b) by 1275 days.

(21) Appl. No.: 11/364,460

(22) Filed: Feb. 28, 2006

(65) Prior Publication Data

US 2006/0191099 A1 Aug. 31, 2006

Related U.S. Application Data

(60) Provisional application No. 60/657,559, filed on Feb. 28, 2005.

(51) Int. Cl.
*A47L 5/00* (2006.01)

(52) U.S. Cl. ..... 15/328; 15/327.2; 15/353

(58) Field of Classification Search ..... 15/327.1, 15/327.6, 328, 352, 353, 329
See application file for complete search history.

(56) References Cited

U.S. PATENT DOCUMENTS

| | | | | | |
|---|---|---|---|---|---|
| 2,627,937 | A | * | 2/1953 | Martinet | 55/372 |
| 2,867,231 | A | * | 1/1959 | Gerstmann | 137/202 |
| 3,485,671 | A | * | 12/1969 | Stephens | 134/7 |
| 3,490,208 | A | * | 1/1970 | Meyer et al. | 55/356 |
| 3,942,217 | A | * | 3/1976 | Bates | 15/321 |
| 4,226,000 | A | * | 10/1980 | Tribolet | 15/321 |
| 4,325,162 | A | * | 4/1982 | Chambers et al. | 15/327.5 |
| 4,341,540 | A | * | 7/1982 | Howerin | 55/307 |
| 4,458,377 | A | * | 7/1984 | Frohbieter | 15/320 |
| 4,654,926 | A | | 4/1987 | McCambridge et al. | |
| 4,826,514 | A | * | 5/1989 | Griffis | 96/360 |
| 4,838,907 | A | * | 6/1989 | Perry | 55/381 |
| 4,845,793 | A | * | 7/1989 | Meyer | 15/328 |
| 4,868,949 | A | * | 9/1989 | Loveless et al. | 15/352 |
| 4,934,017 | A | | 6/1990 | Kent et al. | |
| 4,960,446 | A | * | 10/1990 | Werner et al. | 55/312 |

(Continued)

FOREIGN PATENT DOCUMENTS

KR 20030016807 A 3/2003

(Continued)

OTHER PUBLICATIONS

International Preliminary Report on Patentability for International Application No. PCT/U2006/007358, dated Sep. 11, 2007.

(Continued)

*Primary Examiner* — Lee D Wilson
*Assistant Examiner* — Jamal Daniel
(74) *Attorney, Agent, or Firm* — Marshall, Gerstein & Borun LLP; Robert M. Gerstein; Richard M. LaBarge

(57) ABSTRACT

The disclosed vacuum cleaner has a smaller, separable vacuum unit that is releasably attached to a larger, base unit tank assembly. It provides a combination vacuum cleaner that has small- and large-capacity configurations suited for vacuum applications having different volumes, locations, or other features. The vacuum cleaner includes a single vacuum source sized for use with the larger tank structure, yet coupled to and removable integrally with the smaller vacuum unit. The smaller vacuum unit can be quickly and easily attached to and removed from the larger tank assembly to facilitate use of the vacuum cleaner in the desired configuration.

3 Claims, 10 Drawing Sheets

U.S. PATENT DOCUMENTS

| | | | | | |
|---|---|---|---|---|---|
| 4,980,945 | A | * | 1/1991 | Bewley | 15/339 |
| 4,995,137 | A | * | 2/1991 | Reichborn | 15/327.1 |
| 5,015,274 | A | * | 5/1991 | Perry | 95/278 |
| 5,054,157 | A | * | 10/1991 | Werner et al. | 15/328 |
| 5,178,823 | A | * | 1/1993 | Hughes | 376/310 |
| 5,210,902 | A | * | 5/1993 | Lee et al. | 15/321 |
| 5,301,386 | A | * | 4/1994 | Thomas et al. | 15/321 |
| 5,311,637 | A | * | 5/1994 | Broussard | 15/301 |
| 5,388,301 | A | * | 2/1995 | Bosyj et al. | 15/327.1 |
| 5,404,614 | A | * | 4/1995 | Stephens | 15/327.2 |
| 5,428,865 | A | * | 7/1995 | Yarbrough | 15/353 |
| 5,455,983 | A | * | 10/1995 | Crouser et al. | 15/331 |
| 5,525,396 | A | * | 6/1996 | Rudolph et al. | 428/131 |
| 5,606,769 | A | | 3/1997 | Tomasiak et al. | |
| 6,027,541 | A | * | 2/2000 | Siemers | 55/429 |
| 6,055,700 | A | * | 5/2000 | Holsten et al. | 15/327.2 |
| 6,083,307 | A | * | 7/2000 | Dular | 96/279 |
| 6,122,796 | A | * | 9/2000 | Downham et al. | 15/328 |
| 6,154,919 | A | * | 12/2000 | Hetko | 15/339 |
| 6,158,083 | A | * | 12/2000 | Holsten | 15/326 |
| 6,210,457 | B1 | * | 4/2001 | Siemers | 55/429 |
| 6,358,005 | B1 | * | 3/2002 | Berfield | 415/206 |
| 6,467,124 | B1 | * | 10/2002 | Small | 15/401 |
| D470,279 | S | | 2/2003 | Griffin et al. | |
| 6,530,116 | B2 | * | 3/2003 | Berfield et al. | 15/328 |
| 6,767,380 | B2 | * | 7/2004 | von Stackelberg, Jr. | 55/431 |
| 6,898,821 | B1 | * | 5/2005 | Bisbee et al. | 15/353 |
| 7,293,323 | B1 | * | 11/2007 | Hoce | 15/321 |
| 7,316,049 | B1 | * | 1/2008 | Robinson et al. | 15/327.2 |
| D633,668 | S | * | 3/2011 | Griffin et al. | D32/23 |
| 2003/0014829 | A1 | * | 1/2003 | Wang | 15/320 |
| 2006/0191099 | A1 | * | 8/2006 | Fry et al. | 15/353 |
| 2009/0044371 | A1 | * | 2/2009 | Yoo et al. | 15/327.2 |

FOREIGN PATENT DOCUMENTS

| | | |
|---|---|---|
| WO | WO 2005/011459 | 2/2005 |

OTHER PUBLICATIONS

International Search Report for International Application No. PCT/US2006/007358, dated May 26, 2006.

* cited by examiner

DUAL-TANK VACUUM CLEANER

FIELD OF THE DISCLOSURE

The present disclosure generally relates to vacuum cleaners, and more particularly to wet/dry tank-type vacuum cleaners.

BACKGROUND OF THE DISCLOSURE

Tank-type vacuum cleaners are capable of receiving dry materials, such as debris or dirt, as well as liquids. Such vacuum cleaners typically include an air impeller disposed inside an air impeller housing that is in fluid communication with an interior of the tank. The air impeller creates a low-pressure area in the tank for vacuuming the dry and liquid materials. A motor is operatively coupled to the air impeller.

Wet/dry vacuum cleaners are provided in a variety of sizes for different applications. In general, the size of the tank and motor varies depending on the amount of debris and/or liquids to be vacuumed. Accordingly, large-volume tanks and larger motors are provided in vacuum cleaners intended for larger jobs, while small-volume tanks and smaller motors are provided in units intended for use in smaller jobs. Larger units are heavier and harder to carry, and therefore are typically provided on casters to facilitate movement along a generally planar surface. As such, larger units are commonly used to collect debris and/or liquid from floors, the ground, or similar areas. While smaller units have a reduced volume capacity, they are lighter and easier to carry and therefore may be used in areas in which the larger units are unsuitable or difficult to use. For example, smaller units may be used to vacuum flights of stairs, gutters, or other areas that are spaced from the floor or ground or otherwise require the vacuum cleaner to be carried during use.

It is often desirable to use a vacuum cleaner having a collection capacity that generally matches the volume of debris and/or liquid to be vacuumed. Notwithstanding the above-mentioned portability issues, considerations associated with emptying collected debris and/or liquid, maintenance, and cleaning of the vacuum cleaner make it desirable to substantially match the capacity of the vacuum cleaner with the volume of material to be vacuumed. As such, users are inclined to use a smaller vacuum cleaner for smaller volume jobs and a larger vacuum cleaner for larger volume jobs. Unfortunately, a user confronted with both small and larger volume jobs must either attempt to use a single vacuum cleaner in both applications or purchase two or more vacuum cleaners each suited for a particular job.

DETAILED DESCRIPTION

The disclosed vacuum cleaner has a smaller, separable vacuum unit that is releasably attached to a larger, base unit tank assembly. It provides a combination vacuum cleaner that has small- and large-capacity configurations suited for vacuum applications having different volumes, locations, or other features. The vacuum cleaner includes a single vacuum source sized for use with the larger tank structure, yet coupled to and removable integrally with the smaller vacuum unit. The smaller vacuum unit can be quickly and easily attached to and removed from the larger tank assembly to facilitate use of the vacuum cleaner in the desired configuration.

Figure 6:
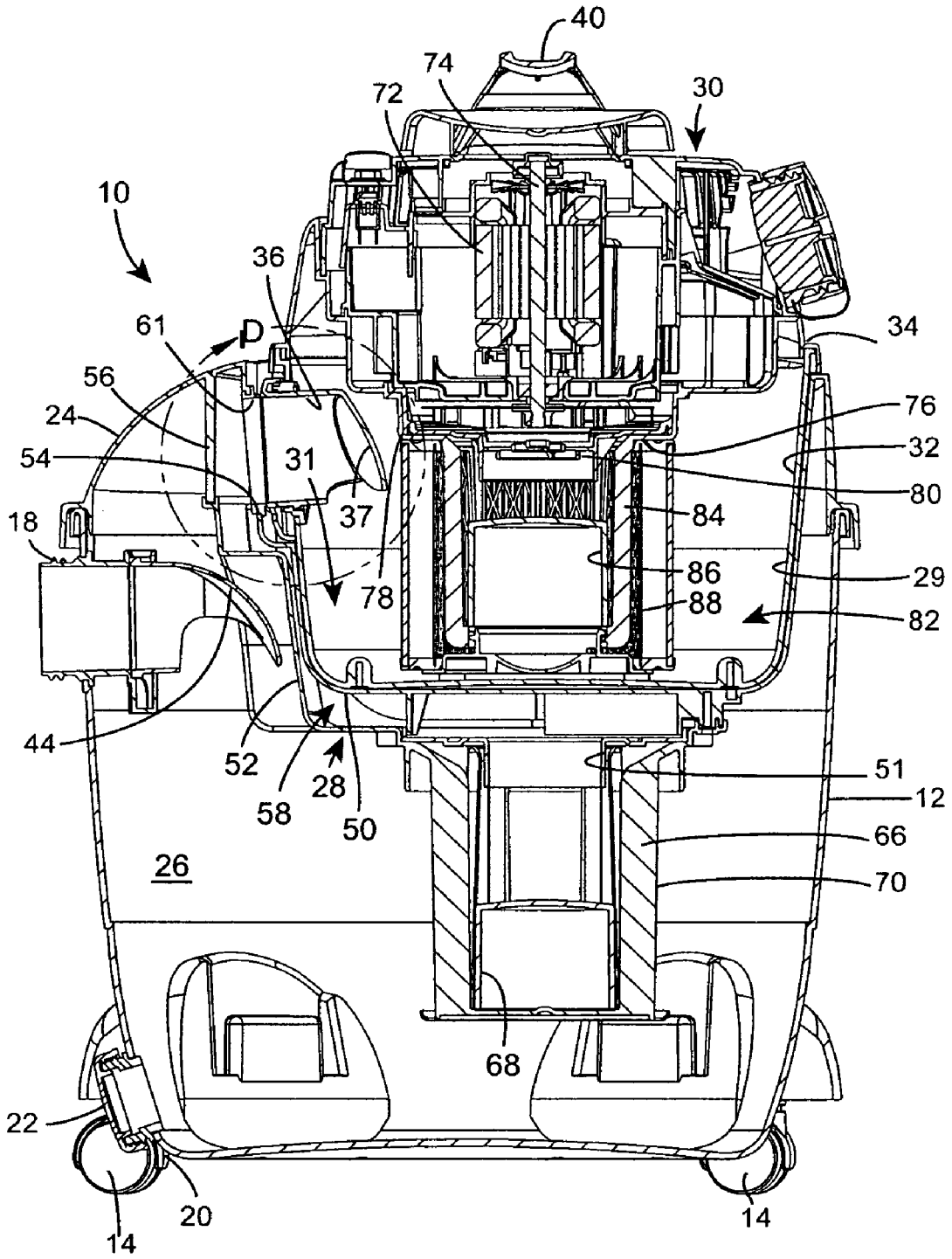
FIG. 6 is a side elevation view of the vacuum cleaner in cross-section taken along line A-A of FIG. 3.
Figure 7:
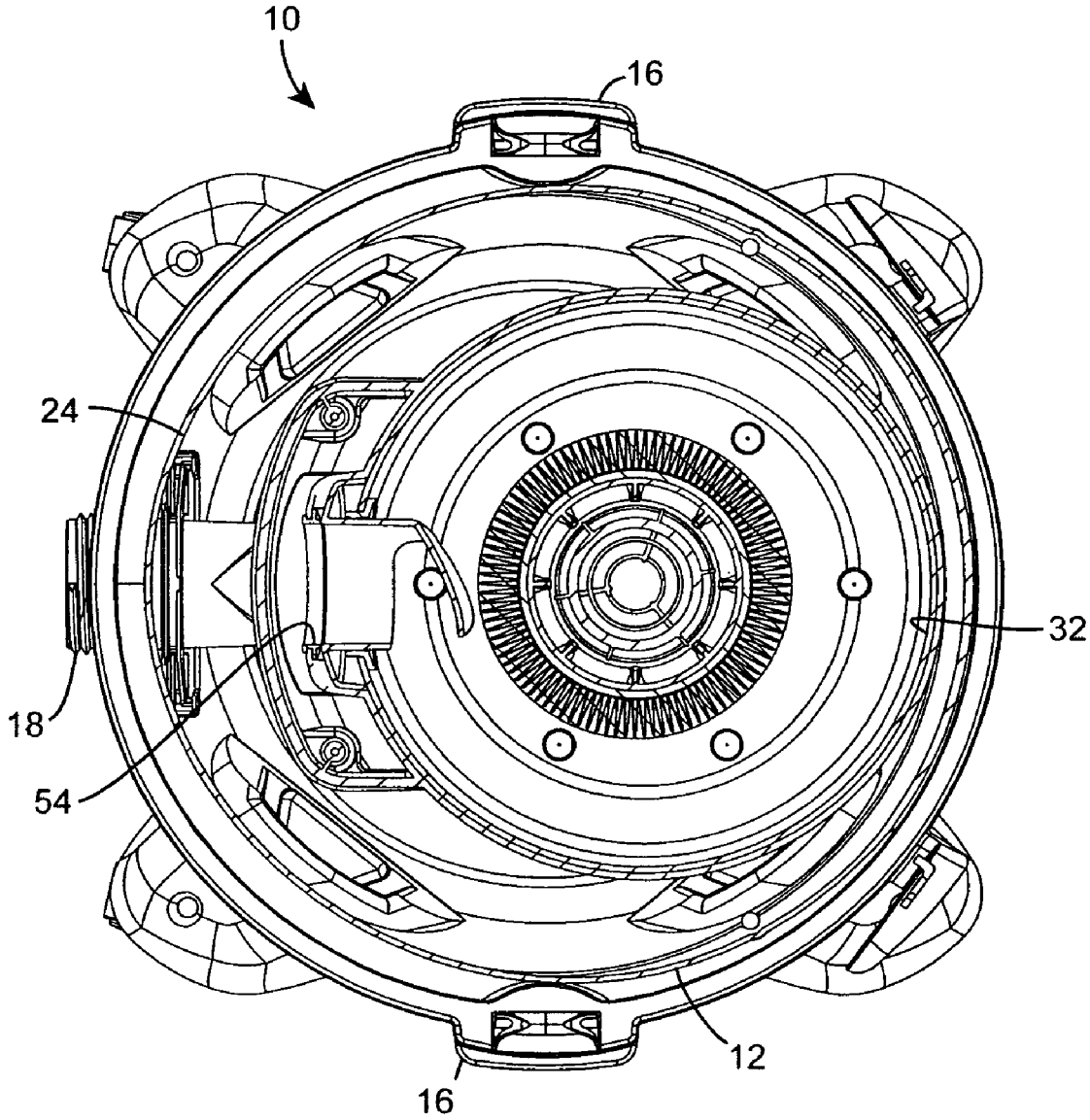
FIG. 7 is a plan view of the vacuum cleaner in cross-section taken along line B-B of FIG. 4.

A vacuum cleaner 10 in accordance with the present disclosure is illustrated at FIGS. 1-8. The vacuum cleaner 10 includes a base unit 11 that has a first tank 12 supported on casters 14. The tank 12 includes handles 16 to assist the user in lifting and moving the vacuum cleaner 10, and has an inlet 18 and an outlet 20 covered by a removable cap 22. A lid assembly 24 is releasably attached to an upper part of the first tank 12 by latches 25. The lid assembly encloses at least a portion of the tank, thereby forming a first interior collection chamber 26 inside the tank. As best shown in FIG. 6, the inlet 18 extends into the first tank 12 and includes a deflector 44 that directs air, debris, and liquid into the first interior collection chamber 26.

A separable unit 30 is releasably coupled to the base unit 11. The separable unit 30 includes a second tank 32 and a lid assembly 34 releasably attached to the tank 32 by latches 35. The second tank 32 includes an inlet 36 to a second interior collection chamber 82. The lid assembly 34 includes a handle 40.

Figure 1:
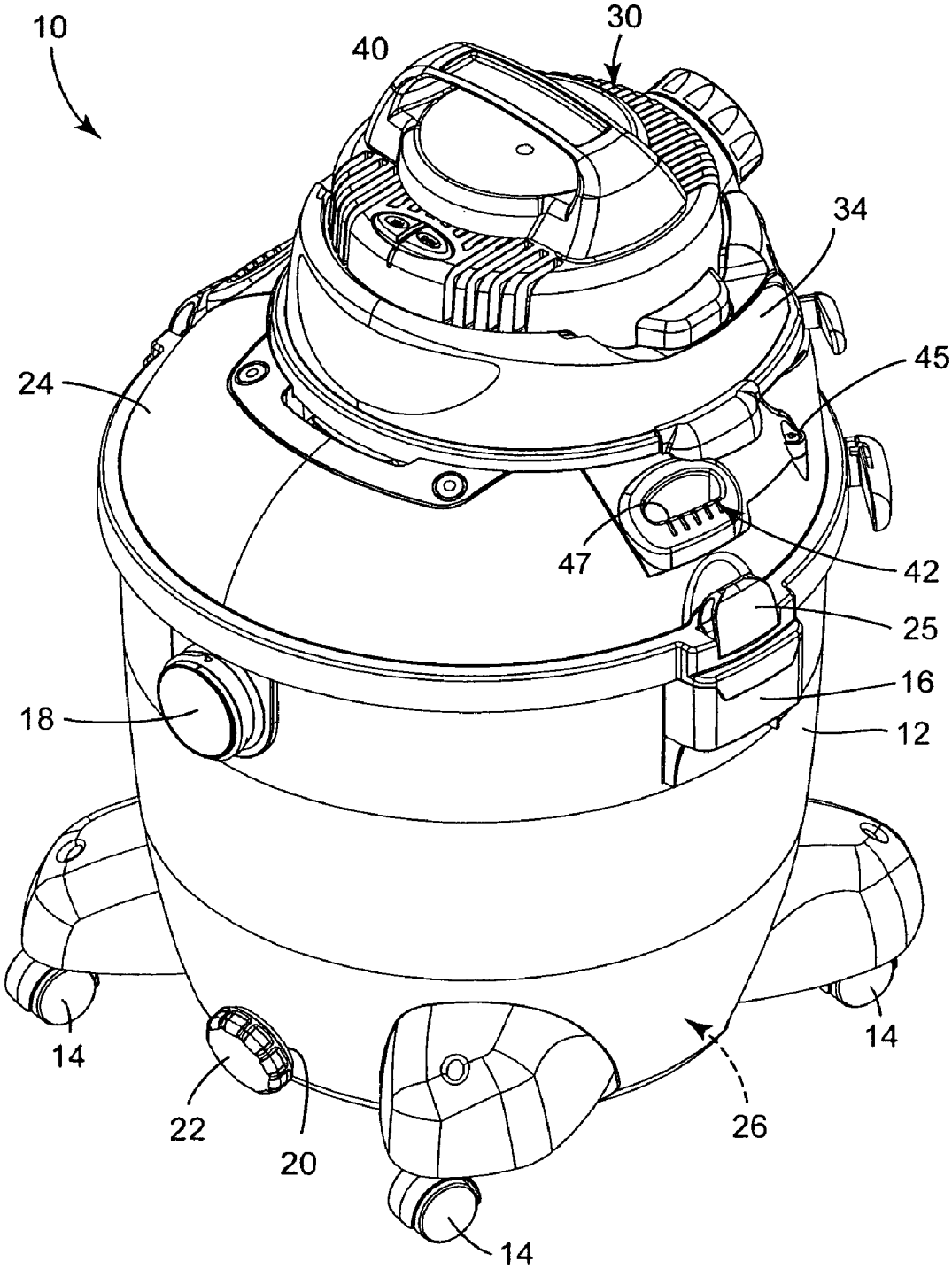
FIG. 1 is a perspective view of one type of a vacuum cleaner that incorporates the new invention.
Figure 2:
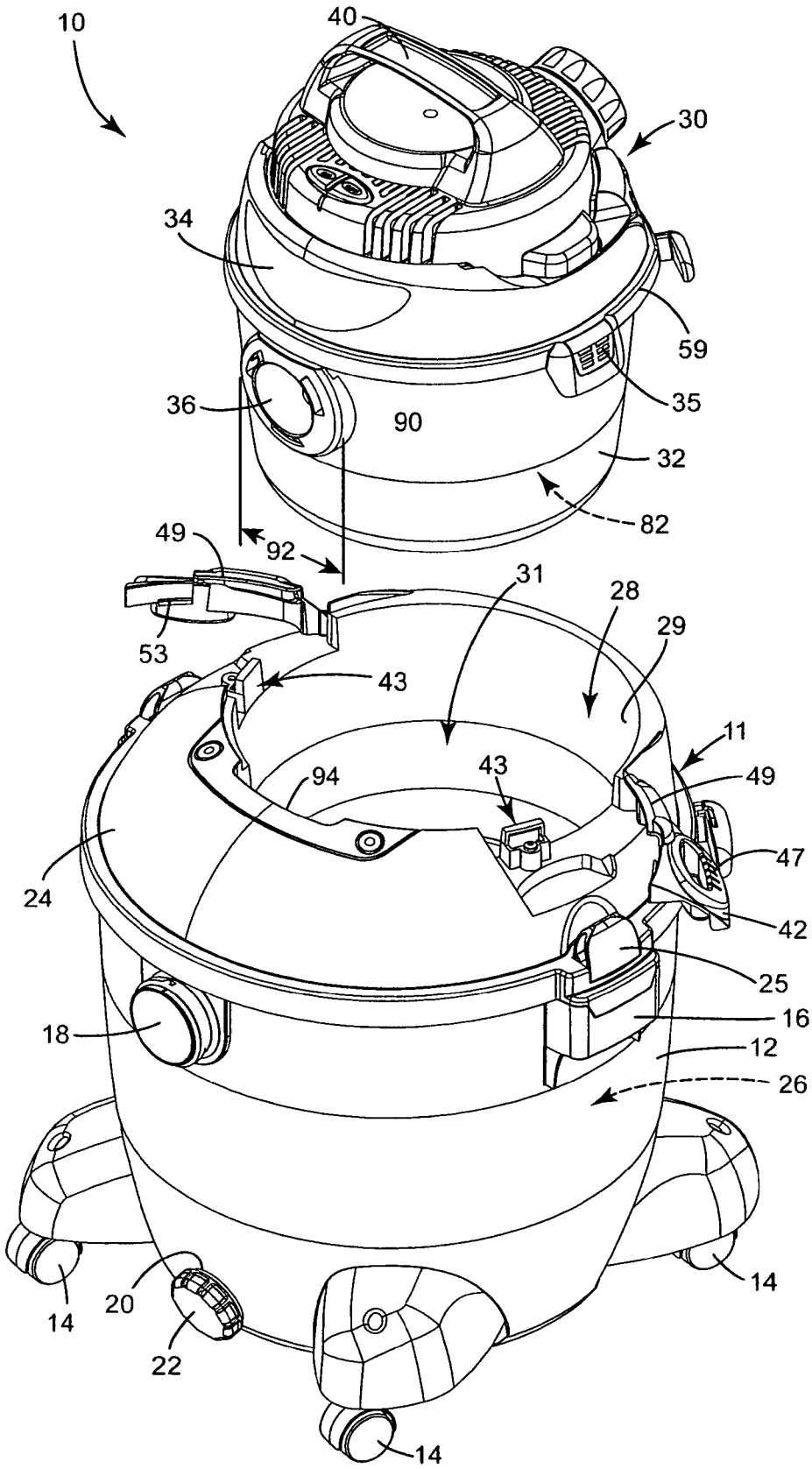
FIG. 2 is a partially-exploded perspective view of the vacuum cleaner of FIG. 1.
Figure 3:
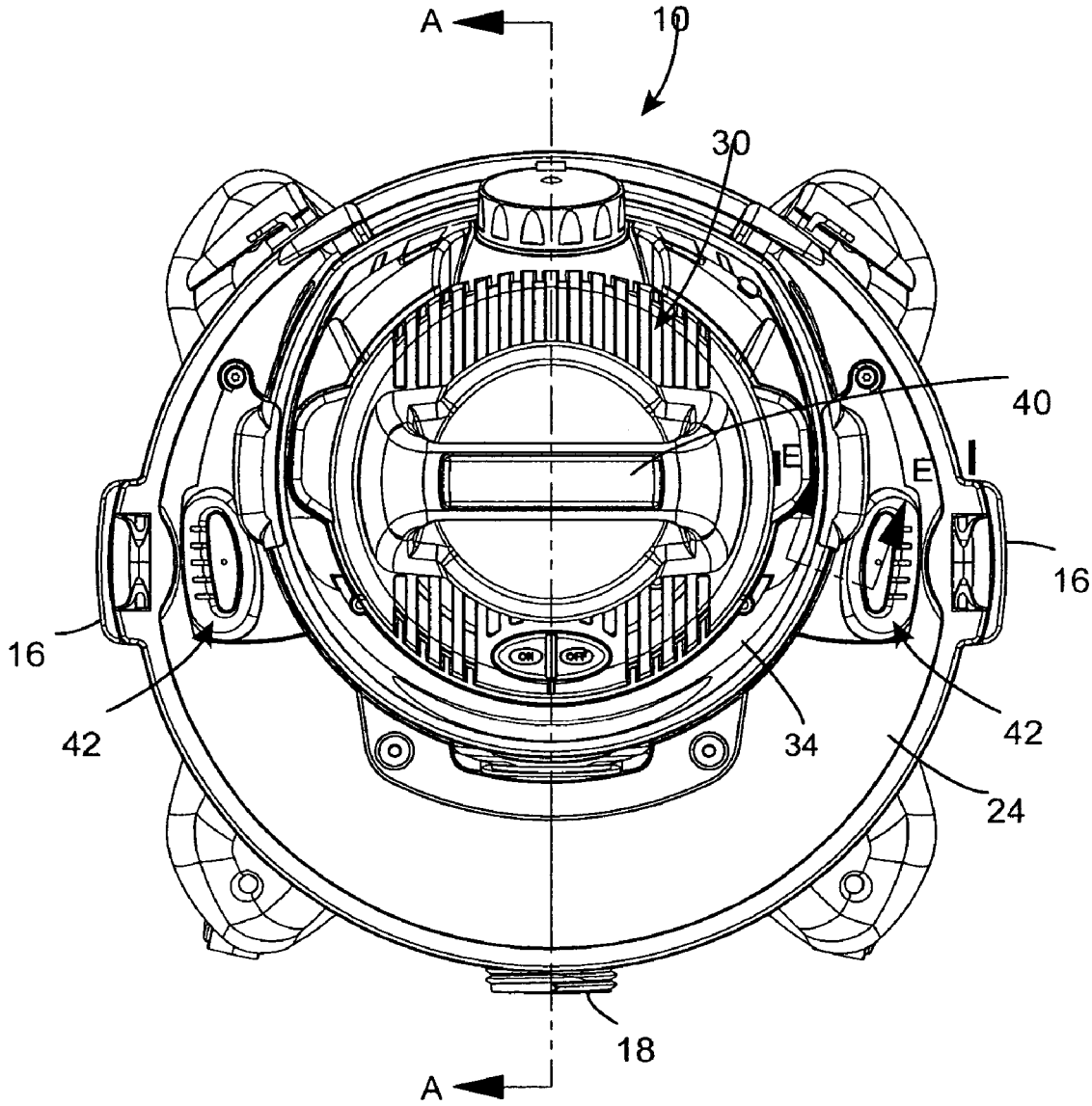
FIG. 3 is a plan view of the vacuum cleaner of FIG. 1.
Figure 4:
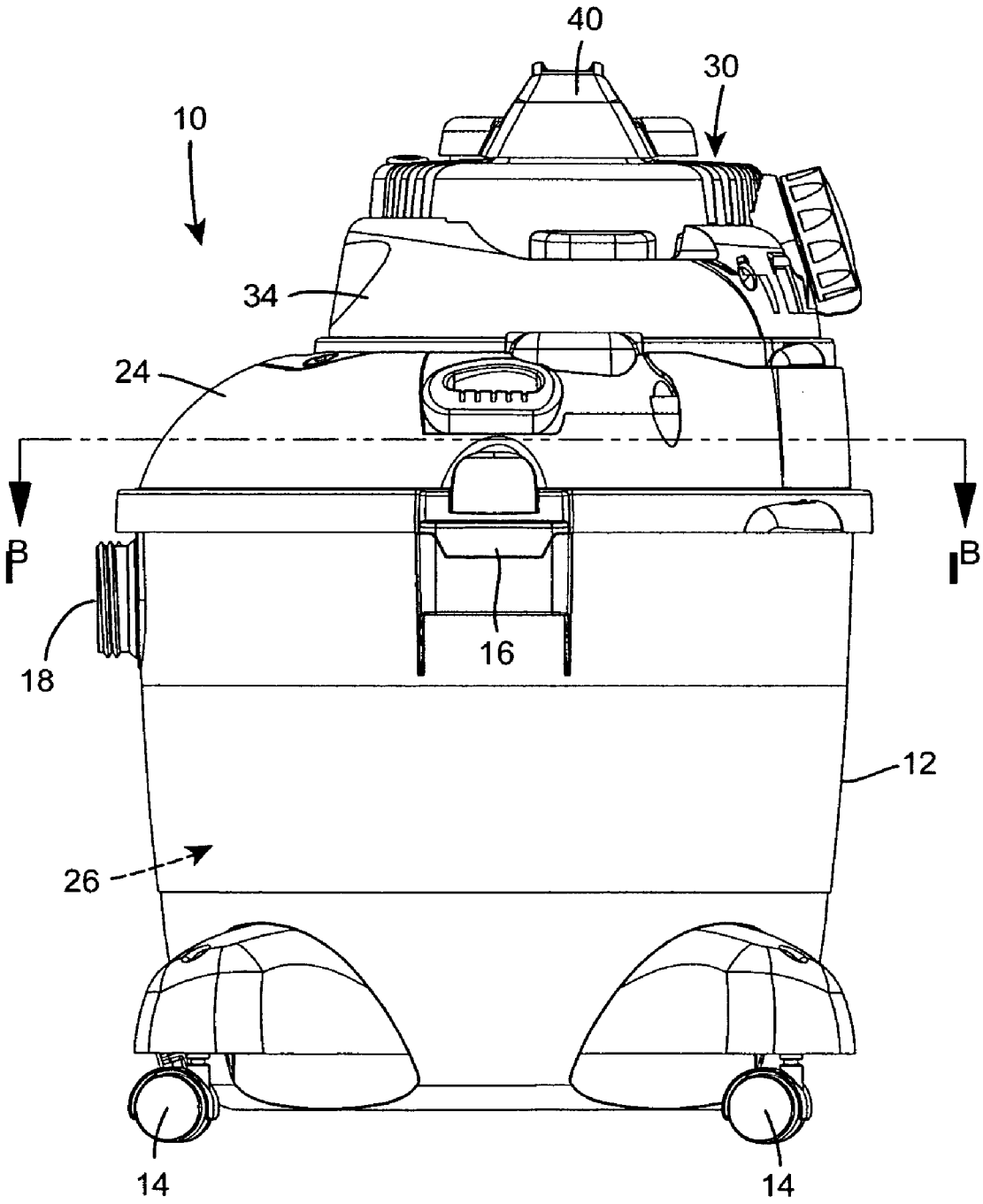
FIG. 4 is a side elevation view of the vacuum cleaner of FIG. 1.
Figure 5:
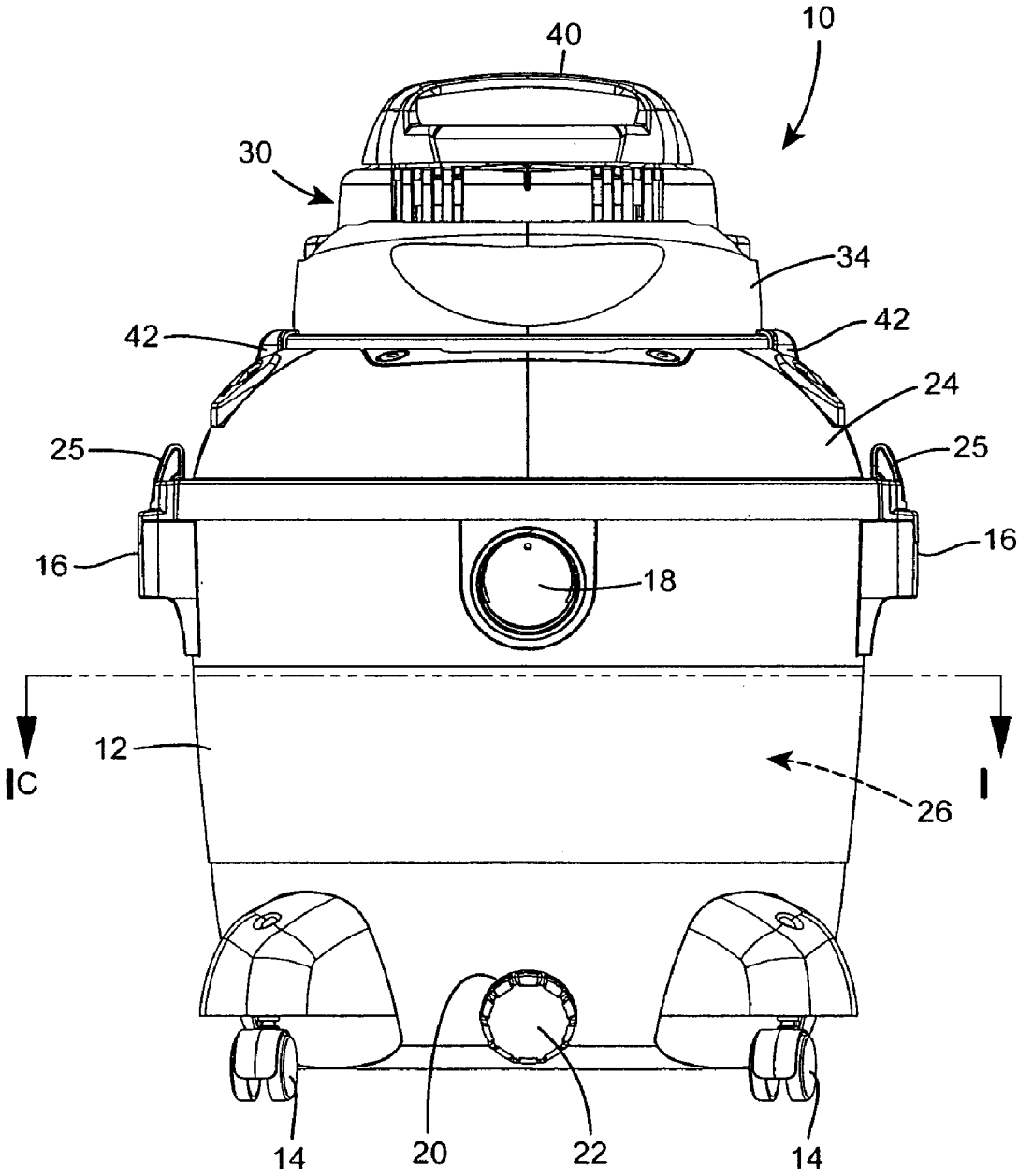
FIG. 5 is a front elevation view of the vacuum cleaner of FIG. 1.
Figure 10:
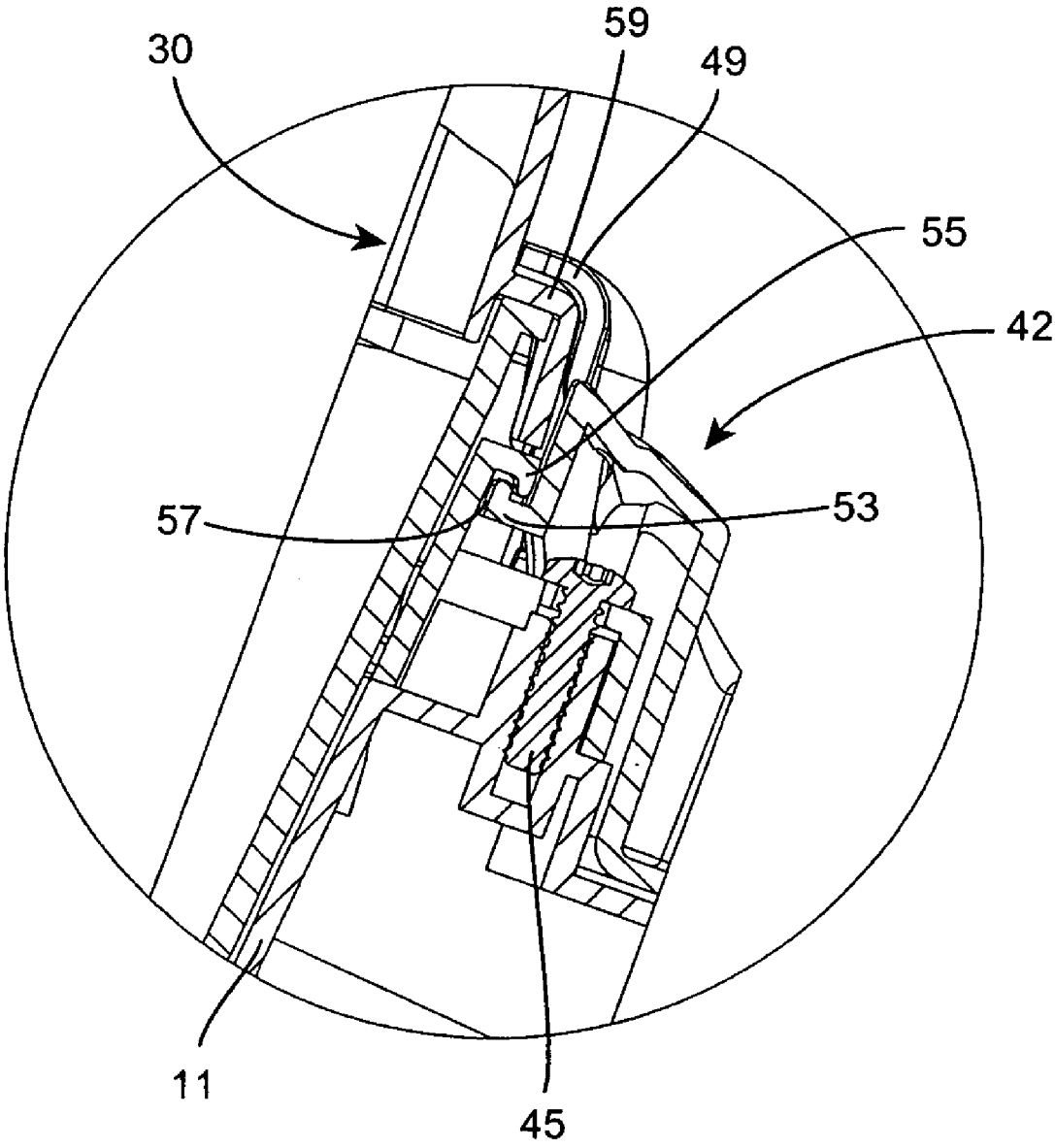
FIG. 10 is an enlarged cross-sectional view taken along line E-E of FIG. 3.

The separable unit 30 is secured to the base unit 11 by releasable fasteners, such as latches 42, which are attached to the outer tank assembly 11. As best shown in FIG. 2, each illustrated latch 42 is releasably engageable with a detent 43 and is pivotable about an axis, such as a screw 45 (FIG. 10) that is threadably fastened to the lid assembly 24. A grip 47 facilitates grasping and movement of the latch 42 about the screw 45. Each illustrated latch 42 further includes a shoulder 49 that projects upwardly and inwardly from the grip 47 and a tab 53 that extends inwardly and upwardly from the grip 47 (FIG. 10). The detent 43 is secured to the lid assembly 24 and includes a lip 55 that extends outwardly and downwardly forming a groove 57.

The illustrated latches 42 may be moved to a locked position, in which the tab 53 is retained in the groove 57 by the lip 55. The tab 53 and the lip 55 are resiliently flexible to allow the tab 53 to slide past the lip 55 to an unlocked position when a force is applied to the grip 47 in an outward direction, and to return to the locked position when an inward force is applied to the grip 47. In the locked position, the shoulder 49 projects over and closely fits against a ridge 59 formed in the lid assembly 34 to maintain engagement of the vacuum unit 30 with the outer tank assembly 11. The latches 42 may be moved to the unlocked position to allow the vacuum unit 30 to be removed from the outer tank assembly 11. Other latch arrangements can also be used.

The first tank 12 and second tank 32 that are illustrated have different capacities. For example, the first tank 12 may hold ten gallons of material, while the second tank 32 may have a two-gallon capacity. The tank volumes suggested here are simply exemplary, as a variety of different sizes may be used for either tank 12, 32. Furthermore, the relative sizes used in this example are not intended to suggest a required or preferred size ratio between the first and second tanks 12, 32.

The separable unit 30 is engageable with the outer tank assembly 11 such that the second tank 32 fluidly communicates with the first tank 12. As best shown in FIG. 6, a receptacle 28 is coupled to the lid assembly 24 of the outer tank assembly 11. The receptacle 28 includes a socket surface 29 that engages the second tank 32 of the separable unit 30. In the illustrated embodiment, the socket surface 29 is generally concave to form a cup-shaped socket space 31. The second tank 32 is sized for at least partial insertion into the socket space 31. The socket surface 31 may closely fit a majority of the exterior surface of the second tank 32, as illustrated.

Figure 9:
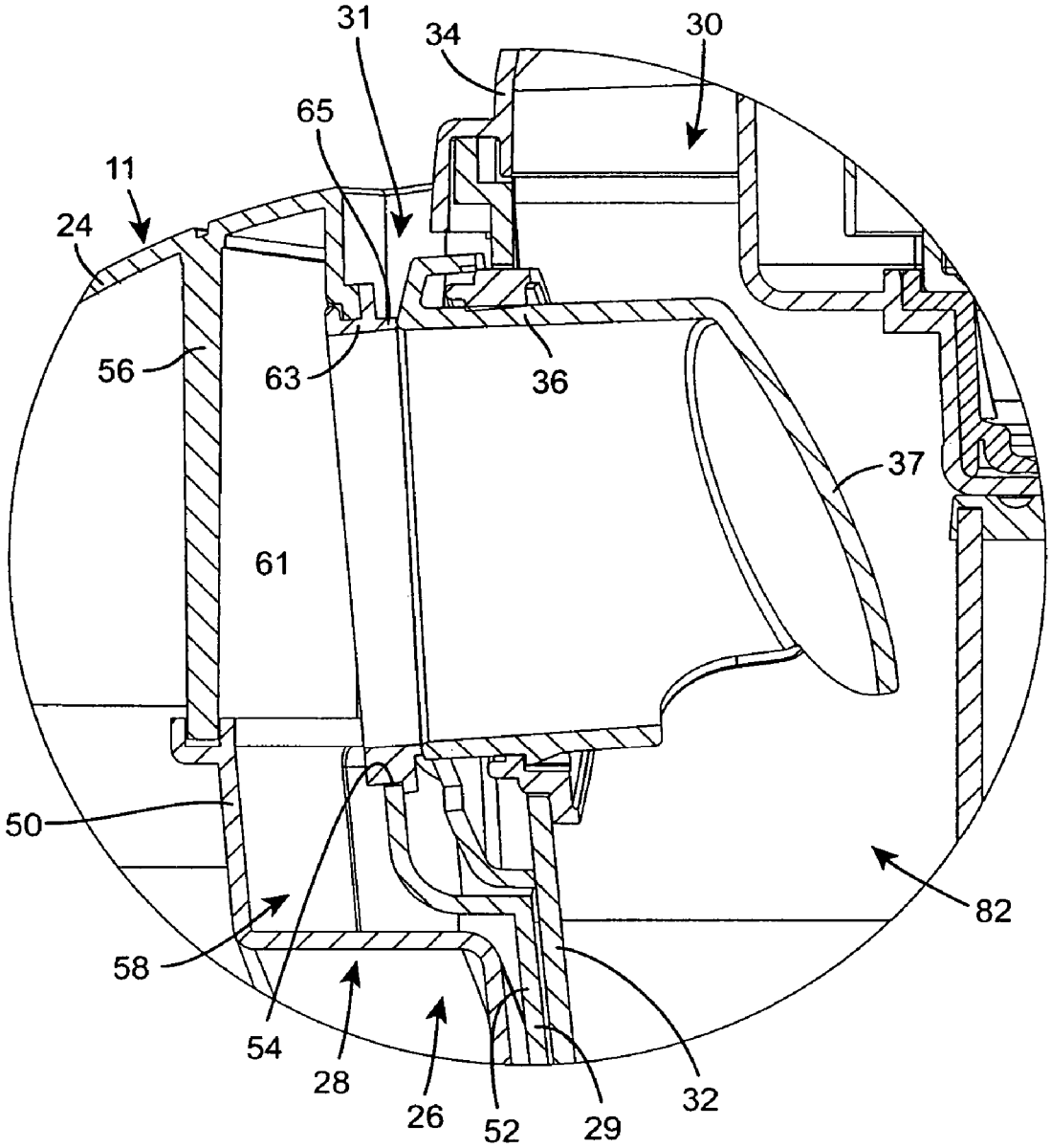
FIG. 9 is an enlarged detail "D" of FIG. 6.

In the illustrated arrangement, an intermediate chamber 58 in the receptacle fluidly communicates between the first interior collection chamber 26 and the second interior collection chamber 82. In the illustrated embodiment, the intermediate chamber 58 is between an inner wall 50 and an outer wall 52. A first aperture 51 in the outer wall 52 establishes fluid communication between the intermediate chamber 58 and the first collection chamber 26. A second aperture 54 is formed in the inner wall 50 and carries a seal 61, best shown in FIG. 9, formed of a resilient material such as rubber. The seal 61 includes a base section 63 that is sized to engage the second aperture 54, and a sealing section 65 that extends into the socket space 31. The sealing section 65 is sized to engage and seal with an exterior of the inlet 36, thereby establishing fluid communication between the intermediate chamber 58 and the second collection chamber 82.

In the exemplary construction illustrated in FIG. 6, the inner wall 50 is formed as part of the lid assembly 24, while the outer wall 52 is coupled to the inner wall 50 and to a rib 56 depending from the lid assembly 24. Furthermore, the inner wall 50 defines the socket surface 29 noted above. In some arrangements, it may be possible to eliminate the inner wall 50 so that the intermediate chamber 58 is formed by the outer wall 52 and by the outside of the second tank 32. In such a case, portions of the outer wall 52 would form the socket surface to engage with and seal to the second tank 32. The double-walled construction is generally preferred because it requires a smaller area to be sealed between the two tanks (thus generally making a better seal more likely) and because it minimizes dust or dirt on the outside of the second tank 32 from entering the intermediate chamber 58 when the separable unit is inserted into the socket space 31.

Figure 8:
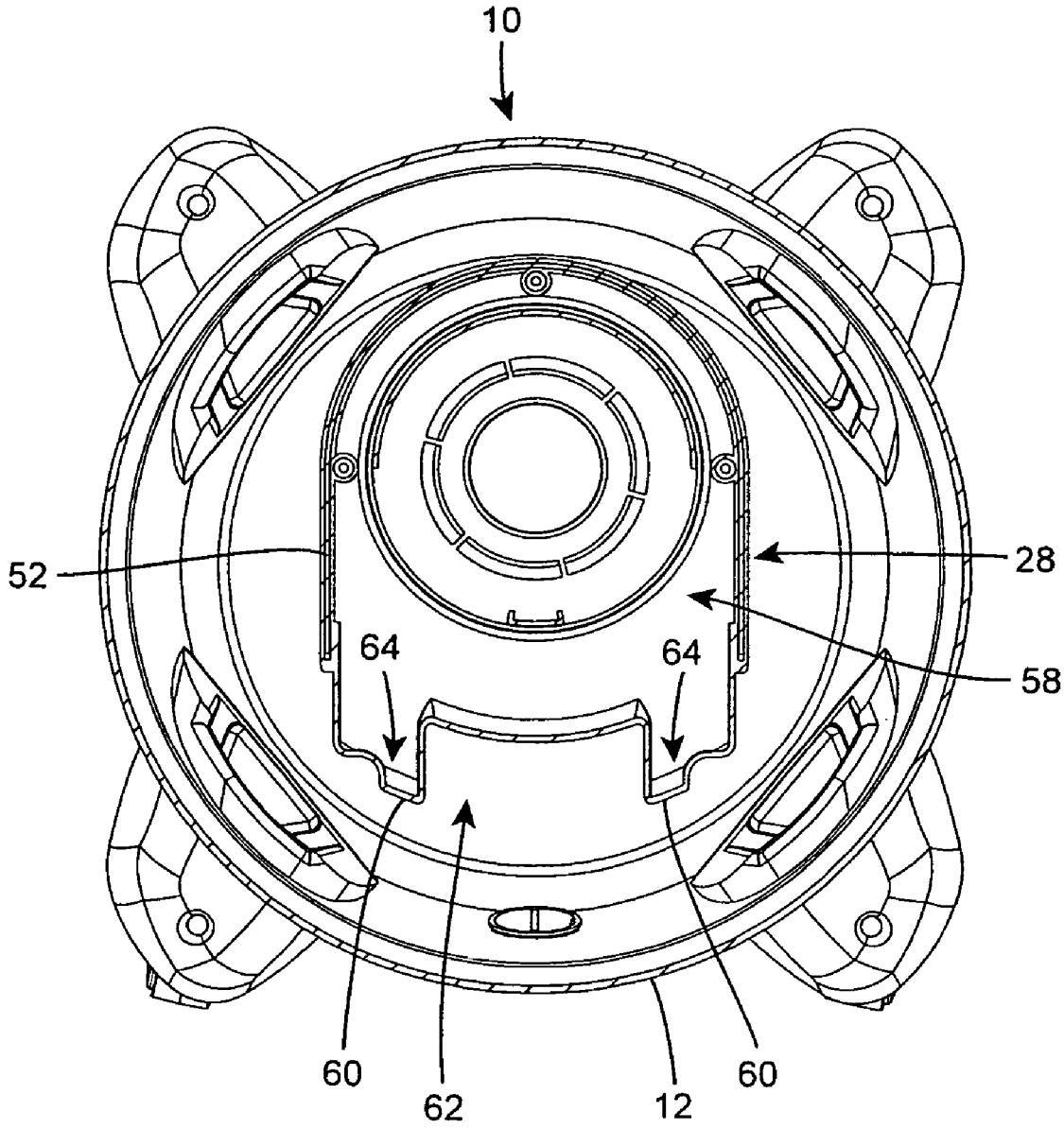
FIG. 8 is a plan view of the vacuum cleaner in cross-section taken along line C-C of FIG. 5.

The shape of the intermediate chamber 58 may be modified to accommodate air flow between the first and second apertures 51, 54 of the receptacle 28. As best seen in FIG. 8, the illustrated outer wall 52 includes two projecting wall portions 60 that define an exterior recess 62. The projecting wall portions 60 create expansion sections 64 in the intermediate chamber 58 that increase airflow capacity through the intermediate chamber. The exterior recess 62 is sized to accommodate at least a portion of the deflector 44 that extends into the first interior collection chamber 26 from the inlet 18.

A filter cage 66 is coupled to the receptacle outer wall 52, as best shown in FIG. 6. The filter cage 66 extends downwardly from the receptacle outer wall 52 and into the first interior collection chamber 26. A float 68 inside the filter cage 66 can interrupt vacuum operations when the first interior collection chamber 26 reaches its liquid capacity, as is well known in the art. A filter 70 is removably attached to the filter cage 66.

A vacuum source is coupled to the lid assembly 34 of the vacuum unit 30 for generating vacuum air flow through the vacuum cleaner 10. As best shown in FIG. 6, the vacuum source includes a motor 72 that rotates a shaft 74 with an air impeller 76. The air impeller 76 is disposed in an air impeller housing 78 that has an aperture 80 in fluid communication with a second or inner interior collection chamber 82 defined by the tank 32.

A filter cage 84 is disposed between the aperture 80 and the second interior collection chamber 82. A float 86 inside the filter cage 84 can cut off vacuum airflow when liquid in the inner tank 32 reaches a maximum level. A filter 88 is removably coupled to the filter cage 84. The vacuum unit inlet 36 also includes a deflector 37 that directs air and material flow into the second interior collection chamber 82.

The receptacle 28 may be shaped to facilitate insertion of the vacuum unit 30 into the receptacle 28 so that the inlet 36 is properly aligned with the interior chamber 58. As best shown in FIG. 2, the vacuum unit inlet 36 extends outwardly from the inner tank 32 to define an inlet projection 90 that has a lateral profile 92. The receptacle outer wall 52 is formed with a channel 94 that is sized to closely fit the inlet rejection lateral profile 92, thereby to automatically orient the inner tank 32 in the receptacle 28. The channel 94 fluidly communicates with the expansion sections 64 to facilitate full capacity airflow through the intermediate chamber 58.

The described vacuum cleaner 10 may be selectively placed in both large-capacity and small-capacity configurations. In large-capacity configuration, the vacuum unit 30 is coupled to the receptacle 28 to generate air flow into the first interior chamber 26 through the inlet 18. To do so, the air impeller 76 is operated by the motor 72 to generate a partial vacuum in the second interior collection chamber 82. The partial vacuum is communicated to the first interior collection chamber 26 through the intermediate chamber 58. Accordingly, suction is generated at the inlet 18 which may be directed to the desired area by a hose (not shown). The vacuum cleaner 10 may be operated in large capacity configuration for large volume vacuum applications.

Operation in the large-capacity configuration may also result in cleaner exhaust air being discharged from the vacuum cleaner 10. In the large-capacity configuration, the air flow path generated by operation of the vacuum source passes through both the filter 70 and the filter 88 before being discharged to atmosphere. This double filtration decreases the amount of particulates or other material that are discharged from the vacuum cleaner 10 with the exhaust air. It should be noted that material is intended to collect only in the outer tank 12 when the vacuum cleaner 10 is operated in the large-capacity configuration. Apart from the small percentage of particulates that are able to pass through the filter 70 but are obstructed by the filter 88, vacuumed material will generally collect only in the outer tank 12 when the illustrated vacuum cleaner is configured for large-capacity applications.

The vacuum cleaner 10 may also be operated in a small-capacity configuration by removing the vacuum unit 30 from the receptacle 28. To do so, latches 42 may be opened so that the vacuum unit 30 may be readily removed from the receptacle 28, exposing the inlet 36. A hose (not shown) may then be attached to an exterior of the inlet 36. Operation of the vacuum cleaner 10 in a small-capacity configuration is substantially similar to most previous wet/dry vacuum cleaners in that the partial vacuum generated by the air impeller 76 is communicated to the inlet 36, drawing material into the second interior collection chamber 82. Partial vacuum in the second interior collection chamber may be directed to the desired location by the hose. Because the inner tank 32 is smaller, the vacuum unit 30 is suitable for use in applications having smaller volumes of material to be collected or requiring a more portable vacuum cleaner.

While the present disclosure describes specific examples, which are intended to be illustrative only and not to be limiting, it will be apparent to those of ordinary skill in the art that changes, additions, and deletions may be made to the exemplary embodiments without departing from the spirit and scope of the disclosure.

The invention claimed is:

1. A vacuum cleaner that has:

an inlet on a base unit;

a collection chamber in the base unit that has an upstream side that is in fluid communication with the inlet;

a separable unit that is releasably engaged to the base unit, can be used as a stand-alone vacuum cleaner, and has a second collection chamber;

an outlet on the separable unit;

a vacuum source in the separable unit that is in fluid communication with the outlet and with the second collection chamber;

a second inlet on the separable unit through which all dust and/or debris enter the second collection chamber when the separable unit is used as a stand-alone vacuum cleaner;

an aperture on the base unit that can be connected to the second inlet, placing the vacuum source in fluid communication with a downstream side of the collection chamber in the base unit;

a projection on the inlet on the separable unit that extends outwardly and has a lateral profile; and a recessed channel on the base unit that is sized to receive the projection on the inlet on the separable unit, and closely fits the lateral profile to automatically orient the separable unit to base unit.

2. A vacuum cleaner that has:

an inlet on a base unit;

a collection chamber in the base unit that has an upstream side that is in fluid communication with the inlet;

a separable unit that is releasably engaged to the base unit and can be used as a stand-alone vacuum cleaner;

a second collection chamber in the separable unit;

an outlet on a separable unit;

a vacuum source in the separable unit that is in fluid communication with the outlet and with the second collection chamber;

a second inlet on the separable unit;

an aperture on the base unit that can be connected to the second inlet, placing the vacuum source in fluid communication with a downstream side of the collection chamber in the base unit;

a projection on the inlet to the separable unit that extends outwardly;

a recessed channel on the base unit that is sized to receive the projection on the inlet on the separable unit; and an expansion section on the base unit that is spaced from the separable unit and is in fluid communication with the recessed channel.

3. A vacuum cleaner that has:

an inlet on a base unit;

a collection chamber in the base unit that has an upstream side that is in fluid communication with the inlet;

a separable unit that is releasably engaged to the base unit and can be used as a stand-alone vacuum cleaner;

a second collection chamber in the separable unit;

an outlet on a separable unit;

a vacuum source in the separable unit that is in fluid communication with the outlet and with the second collection chamber;

a second inlet on the separable unit;

an aperture on the base unit and can be connected to the second inlet, placing the vacuum source in fluid communication with a downstream side of the collection chamber in the base unit;

a projection on the inlet on the separable unit that extends outwardly;

a recessed channel on the base unit that is sized to receive the projection on the inlet on the separable unit;

a deflector on the inlet of the base unit; and an expansion section on the base unit that has a recess that is sized to accommodate at least a portion of the deflector.

* * * * *